US007383015B2

(12) United States Patent
Sato

(10) Patent No.: US 7,383,015 B2
(45) Date of Patent: Jun. 3, 2008

(54) SHEET CONVEYING DEVICE AND IMAGE FORMING APPARATUS

(75) Inventor: Yoji Sato, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 425 days.

(21) Appl. No.: 11/169,649

(22) Filed: Jun. 30, 2005

(65) Prior Publication Data

US 2007/0003345 A1 Jan. 4, 2007

(51) Int. Cl.
*G03G 15/00* (2006.01)

(52) U.S. Cl. ..... 399/392; 399/393

(58) Field of Classification Search ..... 399/392–395, 399/388

See application file for complete search history.

(56) References Cited

U.S. PATENT DOCUMENTS 5,454,555 A * 10/1995 Kiyohara et al. ..... 271/9.01
5,595,380 A * 1/1997 McCue et al. ..... 271/9.09
6,832,759 B2 * 12/2004 Nagasako et al. ..... 271/222
2002/0158405 A1 * 10/2002 Nagasako et al. ..... 271/213
2002/0163119 A1 * 11/2002 Kawata ..... 271/207
2005/0151315 A1 * 7/2005 Yokoi ..... 271/145

FOREIGN PATENT DOCUMENTS

JP 05-004760 A 1/1993

* cited by examiner

*Primary Examiner*—Anthony H. Nguyen
(74) *Attorney, Agent, or Firm*—Foley & Lardner LLP

(57) ABSTRACT

On a relay guide neighboring with a paper supply tray, a guide rib rotated and projected from a guide face is installed, and the width of sheets is controlled, thus an occurrence of skewing of various sheets supplied from a paper supply tray is prevented, and the conveyability of sheets is improved, and the image quality formed on the sheets is improved.

18 Claims, 3 Drawing Sheets

SHEET CONVEYING DEVICE AND IMAGE FORMING APPARATUS

FIELD OF THE INVENTION

The present invention relates to a sheet conveying device for conveying sheets in a plurality of sizes and an image forming apparatus.

DESCRIPTION OF THE BACKGROUND

In an image forming apparatus such as an electro-photographic copying machine, a facsimile, and a printer, for ordinary paper in a specific size with high frequency in use, sheets of paper are supplied using a paper supply cassette. While for sheets of paper or sheet films with low frequency in use, sheets are generally supplied using a manual paper supply tray. When supplying sheets of paper using the paper supply tray, various kinds of sheets of paper supported by the paper supply tray are taken out by paper supply rollers, and then while being guided by a relay guide, the sheets of paper are conveyed toward separation conveying rollers and then register rollers. The paper supply tray, to prevent the sheets of paper on the conveying path from the paper supply tray to the register rollers from skewing, has a side guide slidable for controlling the width of sheets on the sheet support face.

However, for thick paper stiffer than ordinary paper, there is a fear that the side guide may be defeated and moved by a load due to skewing of sheets during paper supply. As a result of movement of the side guide like this, the sheets may be skewed. Further, for sheets in a comparatively small size such as a postal card or a playing card, sheets taken out from the paper supply tray by the paper supply rollers come out from the side guide before reaching the separation conveying rollers. As a result, after passing the side guide position, the sheets may be skewed.

Therefore, conventionally, there is an apparatus available for installing a stopper on the side guide or controlling the slidability of the side guide, thereby preventing the side guide from moving due to a load of sheets. Further, conventionally, there is an apparatus available for supplying sheets in a small size from a close position by the separation conveying rollers and reducing skewing of the sheets coming out from the side guide.

However, in the conventional apparatus, the sheet width is controlled only by the side guide installed on the paper supply tray, so that after passing the side guide position, it is impossible to correct skewing. Therefore, due to skewing caused after passing the side guide, there is a fear that conveying defects such as jamming of sheets and bending of front ends may be caused. Further, when sheets are skewed, it is necessary to greatly arrange the sheets by the register rollers. Therefore, arrangement by the register rollers cannot be executed sufficiently, thus there is a fear that the image quality may be lowered due to an image displacement.

Therefore, a sheet conveying device and an image forming apparatus for surely preventing sheets taken out from the paper supply tray from skewing, guiding the sheets in the separation conveying direction free of skewing. Thereby preventing various kinds of sheets from defective conveying, surely arranging the front ends of the sheets at the position of the register rollers, and forming a good image on the sheets are desired.

SUMMARY OF THE INVENTION

Accordingly, an advantage of the present invention is to provide a sheet conveying device and an image forming apparatus for surely preventing, when guiding sheets taken out from the paper supply tray in a predetermined direction, the sheets from skewing, preventing them from being jammed during conveying, improving the sheet conveyability, surely arranging the front ends of the sheets by the register means, thereby causing no image displacement.

To achieve the above advantage, one aspect of the present invention is to provide a sheet conveying device including a sheet support member having a movable side guide to control a width of sheets, a paper supply member to make contact with and take out the uppermost sheet on the sheet support member, and a relay member having a moving member arranged in the neighborhood of the sheet support member to move swingably and control the width of the sheets to guide the sheets taken out by the paper supply member in a predetermined direction.

DETAILED DESCRIPTION OF THE INVENTION

Figure 1:
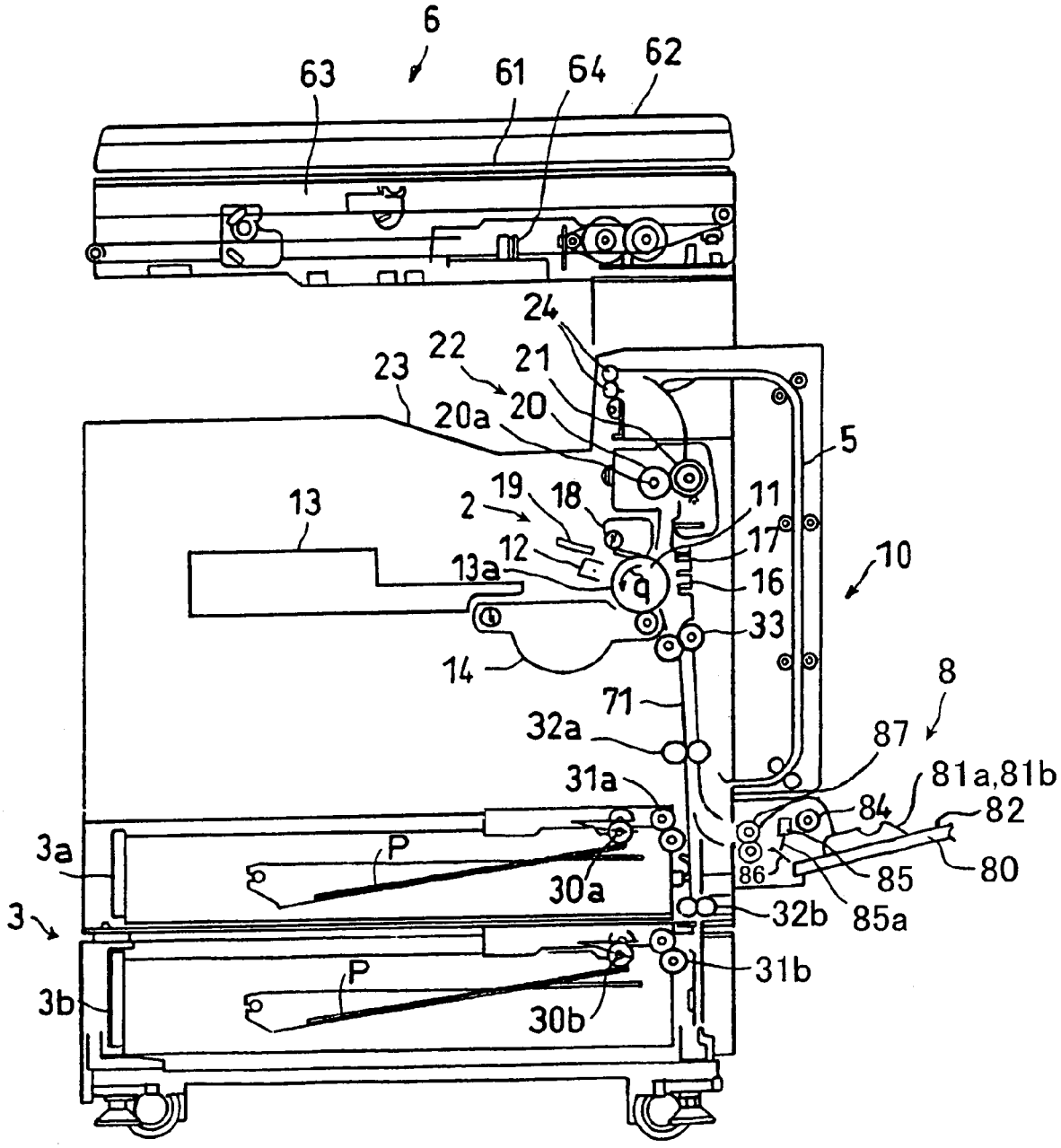
FIG. 1 is a schematic block diagram showing the copier of the embodiment of the present invention.

Hereinafter, by referring to the accompanying drawings, the embodiment of the present invention will be explained in detail. FIG. 1 is a schematic block diagram showing copier 10 which is an image forming apparatus having sheet conveying unit 8 which is a sheet conveying device of the embodiment of the present invention. Copier 10, in addition to sheet conveying unit 8, has cassette mechanism 3 having paper supply cassettes 3*a* and 3*b* for storing sheets of paper P which are sheets supplied to an image forming unit 2. Further, copier 10 has reversible conveying path 5 for reversing sheets of paper P at time of double-side image forming. On the top of copier 10, scanner 6 for reading a document image is installed. Scanner 6 has platen glass 61 for supporting a document, platen 62 for covering document glass 61, optical unit 63 for irradiating light to the document and focusing the reflection light from the document, and CCD scanner unit 64 for reading the light from optical unit 63.

Image forming unit 2 has, around a photosensitive drum 11, main charger 12 for uniformly charging photosensitive drum 11 according to rotation of photosensitive drum 11 in the direction of arrow a, laser exposure device 13 for forming a latent image on charged photosensitive drum 11 on the basis of image data from scanner 6, developing unit 14, transfer charger 16, separation charger 17, cleaner unit 18, and discharging LED 19.

On the downstream side of separation charger 17 in the conveying direction of sheets of paper P, fixing device 22 constituting a part of image forming unit 2 for holding and conveying sheets of paper P by heat roller 20 having built-in heater lamp 20*a* and press roller 21 and heating, pressurizing, and fixing a toner image is installed. On the downstream side of fixing device 22, paper ejection rollers 24 for ejecting sheets of paper P after fixing to paper receiving tray 23 is installed.

On supply conveying path 71 from paper supply cassettes 3*a* and 3*b* to transfer charger 16, first and second pick-up rollers 30*a* and 30*b* for taking out sheets of paper P, first and second separation rollers 31*a* and 31*b*, first and second conveying apparatuses 32*a* and 32*b*, and register rollers 33 are installed.

Figure 2:
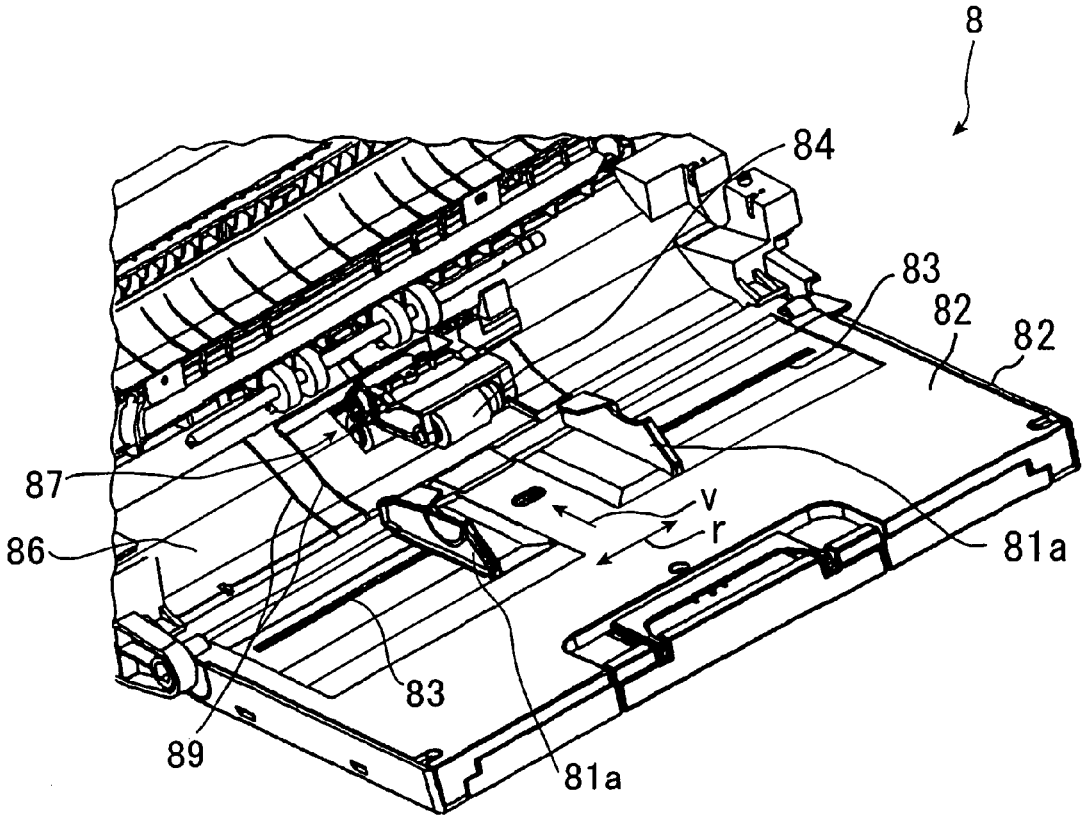
FIG. 2 is a schematic perspective view showing the essential section of the sheet conveying unit of the embodiment of the present invention.

Next, sheet conveying unit 8 will be described in detail. Sheet conveying unit 8, as shown in FIG. 2, has paper supply tray 80 which is a sheet support member for manually supplying sheets of paper P which are various sheets. Paper supply tray 80 has a pair of side guides 81*a* and 81*b* for controlling the width of sheets of paper P in various sizes. Side guides 81*a* and 81*b* can slide in the direction of arrow r perpendicular to the paper supply direction which is the direction of arrow v along slit 83 formed in sheet support face 82 of paper supply tray 80. Namely, side guides 81*a* and 81*b* can slide in parallel with sheet support face 82.

At the position opposite to paper supply tray 80, pick-up roller 84 which is a swingable paper supply member for moving down at time of paper supply and making contact with and taking out the uppermost sheet of paper P is installed. Further, in the neighborhood of pick-up roller 84, actuator 85*a* of a switch 85 for detecting existence of sheets of paper P on paper supply tray 80 is arranged.

On the front end side of paper supply tray 80 in the paper supply direction, relay guide 86 which is a relay member is adjacent. Relay guide 86 guides sheets of paper P taken out from paper supply tray 80 by pick-up roller 84 toward separation conveying roller 87 which is a separation conveying member, that is, in a predetermined direction. Separation conveying roller 87 separates only uppermost sheet of paper P of sheets of paper P taken out from paper supply tray 80 by pick-up roller 84 and supplies it toward first conveying roller 32*a*.

Figure 3:
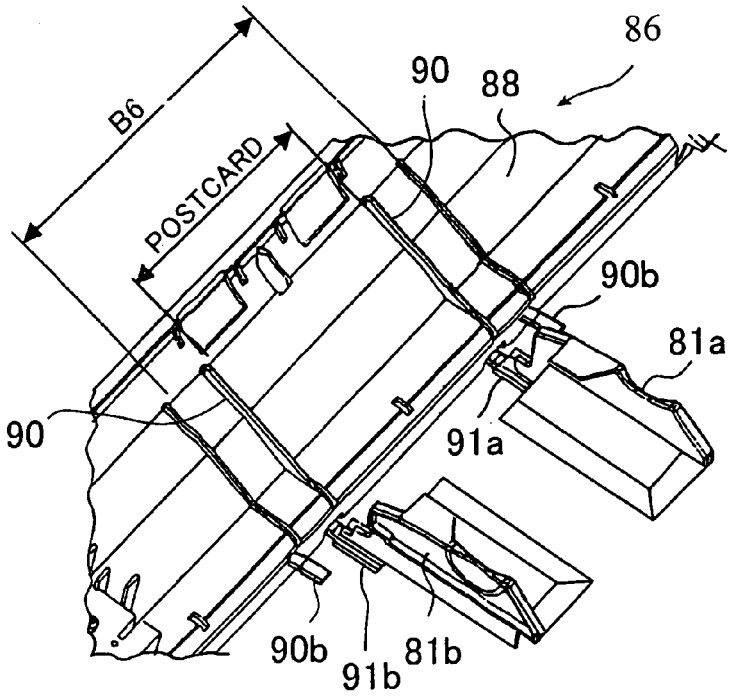
FIG. 3 is a schematic perspective view showing the essential section of the side guide and relay guide of the sheet conveying unit of the embodiment of the present invention.
Figure 4:
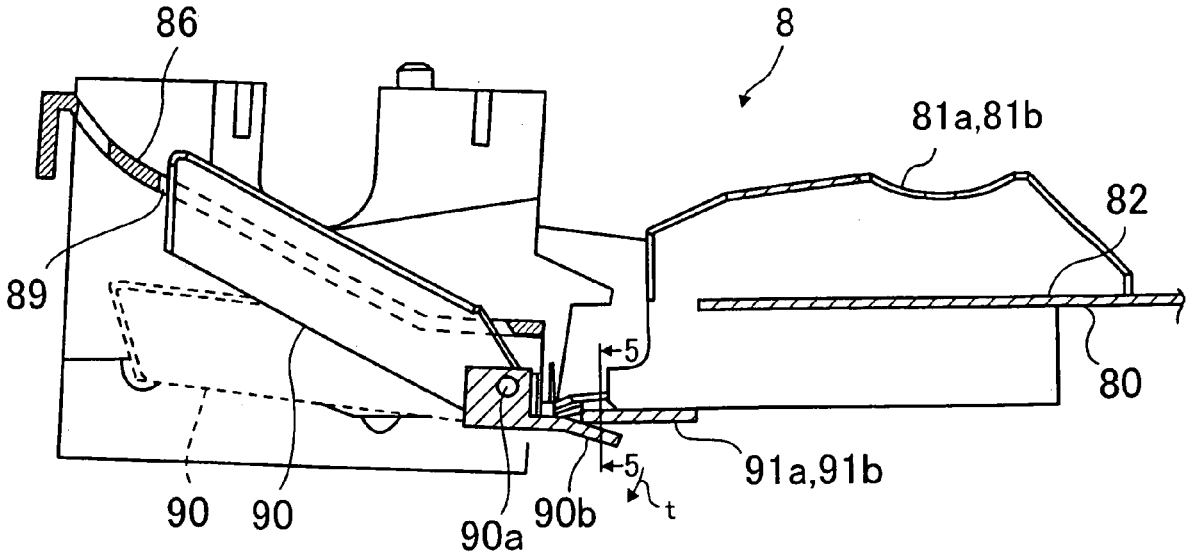
FIG. 4 is a schematic illustration showing rotation of the guide rib by the side guide of the sheet conveying unit of the embodiment of the present invention.

Relay guide 86, as shown in FIGS. 3 and 4, has guide face 88 which is a bottom for supporting the back of sheet of paper P. Furthermore, relay guide 86 has a pair of guide ribs 90 which are moving members for controlling the width of sheets of paper P for each optional size. Guide ribs 90 move perpendicularly to guide face 88 in link motion with side guides 81*a* and 81*b*. In guide face 88, in accordance with the width of sheets of paper P such as a postal card or size B6 (JIS Standard), a plurality of insertion ports 89 which are slit-shaped openings are formed.

At the position of each insertion port 89, guide rib 90 is arranged. Each guide rib 90 can rotate around supporting point 90*a*. At the end of guide rib 90 on the side of supporting point 90*a*, lever 90*b* in contact with side guides 81*a* and 81*b* is formed. Guide rib 90 is always stored under guide face 88 by its own weight.

Figure 5:
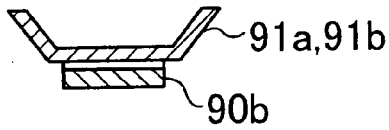
FIG. 5 is a cross sectional view of the line 5-5 shown in FIG. 4 of the embodiment of the present invention.

On the other hand, at the front ends of the bottoms of side guides 81*a* and 81*b*, projections 91*a* and 91*b* tapered on both sides thereof are attached. The section of projections 91*a* and 91*b* is shown in FIG. 5. Projections 91*a* and 91*b* make contact with lever 90*b* of guide rib 90 and are inserted between lever 90*b* and relay guide 86 via the taper, thereby rotate lever 90*b* in the direction of arrow t, and project guide rib 90 from guide face 88 of relay guide 86.

Next, the operation of the invention will be described. For example, when manually supplying sheets of paper P in a size of a postal card from paper supply tray 80 and forming an image, firstly sheets of paper P are loaded on paper supply tray 80. Next, side guides 81*a* and 81*b* slide and move along slit 83, are made fit to the width of sheets of paper P, and control the width of sheets of paper P on paper supply tray 80.

When side guides 81*a* and 81*b* move to the position of postal card size, projections 91*a* and 91*b* of side guides 81*a* and 81*b* are inserted between lever 90*b* of guide rib 90 installed at the position of postal card size and relay guide 86 via the taper. By doing this, lever 90*b* of guide rib 90 installed at the position of postal card size is rotated in the direction of arrow t and guide rib 90 is rotated and moved from the position indicated by the dotted line in FIG. 4 to the position indicated by the solid line and is projected from guide face 88 of relay guide 86. Namely, on guide face 88 of relay guide 89, a guide for sheets of paper P for controlling the width of postal card size by guide rib 90 in link motion with side guides 81*a* and 81*b* is formed.

When side guides 81*a* and 81*b* and guide rib 90 interlocked with them are set like this and then the image forming process is started, scanner 6 reads a document. In image forming unit 2, photosensitive drum 11 is uniformly charged by main charger 12 according to the rotation in the direction of arrow q and then is irradiated with a laser beam according to a document image by laser exposure device 13, thus an electrostatic latent image is formed. Then, the electrostatic latent image is developed by developing unit 14 and a toner image is formed on photosensitive drum 11.

On the other hand, in sheet conveying unit 8, sheets of paper P in a size of postal card positioned on paper supply tray 80 by pick-up roller 84 are controlled in width by side guides 81*a* and 81*b* and are taken out in the direction of arrow v while being prevented from an occurrence of skewing. Then, sheets of paper P are guided by relay guide 86 and are supplied to separation conveying roller 87. At this time, on guide face 88 of relay guide 86, guide rib 90 for controlling the width of a postal card is projected. Therefore, sheets of paper P are controlled in width even on relay guide 86 and is guided toward separation conveying roller 87 while being prevented from an occurrence of skewing.

Then, for sheets of paper P, only the uppermost one sheet is separated by separation conveying roller 87 and reaches register rollers 33 via first conveying apparatus 32*a*. Until reaching register rollers 33, sheet of paper P is controlled in width on paper supply tray 80 by side guides 81*a* and 81*b* and is prevented from an occurrence of skewing. Furthermore, sheet of paper P is small in size like a postal card, so that before being surely separated and conveyed by separation conveying roller 87, it is dislocated from side guides 81*a* and 81*b*. However, after dislocated from side guides 81*a* and 81*b*, it is controlled in width by guide rib 90 projected on relay guide 86 and is prevented from an occurrence of skewing. Therefore, no jamming is caused by skewing during conveyance and sheets of paper P reaches register rollers 33. Further, the arrangement amount of sheet of paper P at the position of register rollers 33 is small, so that the front end of sheet of paper P is arranged easily and surely by register rollers 33.

After arrangement by register rollers 33, sheet of paper P is conveyed to the position of transfer charger 16 in synchronization with a toner image on photosensitive drum 11 and is transferred with the toner image. Then, sheet of paper P is separated from photosensitive drum 11 by separation charger 17. After separation of sheet of paper P, photosensitive drum 11 is cleaned residual toner by cleaning unit 18, is removed residual electric charge by discharging LED 19, and waits for the next image forming process. Sheet of paper P separated from photosensitive drum 11, after the toner image is heated, pressurized, and fixed by fixing device 22, is ejected to paper ejection tray 23.

After image forming on sheet of paper P in a size of postal card supplied from paper supply tray 80 is all completed, when side guides 81*a* and 81*b* slide and move, for example, to the position of size A4, guide rib 90 for controlling the width of postal card is stored under guide face 88. Namely, when side guides 81*a* and 81*b* slide and move to the position of size A4, projections 91*a* and 91*b* of side guides 81*a* and 81*b* are separated from lever 90*b* of guide rib 90 installed at the position of postal card size via the taper and pass between lever 90*b* of guide rib 90 and relay guide 86. By doing this, guide rib 90 rotates and moves in the opposite direction to the direction of arrow t by its own weight and is stored under guide face 88.

Therefore, hereafter, guiding of sheets of paper P in a size larger than a postal card toward separation conveying roller 87 by relay guide 86 is executed smoothly free of obstruction by guide rib 90 for controlling the width of a postal card.

Further, when manually supplying sheets of paper P in a size of B6 from paper supply tray 80, in the same way as with sheets of paper P in a size of postal card, side guides 81*a* and 81*b* slide and move along slit 83 in accordance with the width of sheets of paper P. In link motion with it, guide rib 90 at the position of size B6 is rotated in the direction of arrow t and is projected from guide face 88 of relay guide 86. Namely, on guide face 88 of relay guide 89, in link motion with side guides 81*a* and 81*b*, a guide of sheets of paper P controlled to the width of size B6 by guide rib 90 is formed.

According to this embodiment, on relay guide 86 for guiding sheets of paper P from paper supply tray 80 toward separation conveying roller 87, guide rib 90 which rotates in link motion with side guides 81*a* and 81*b*, is projected from guide face 88, and controls the width of sheets of paper P is installed. By doing this, also for sheets of paper P in a small size, after passing side guides 81*a* and 81*b*, the width is controlled by guide rib 90 on relay guide 86 and an occurrence of skewing can be prevented. Further, also for stiff sheets of paper P, the width of sheets of paper P is controlled together with side guides 81*a* and 81*b* and guide rib 90, thus side guides 81*a* and 81*b* are prevented from moving due to a load of sheets of paper P and an occurrence of skewing can be prevented. Therefore, during conveying to register rollers 33, jamming due to skewing can be prevented and the conveyability of sheets of paper P can be improved. Further, the front ends of sheets of paper P can be arranged easily and surely by register rollers 33, and the image displacement is prevented, and the image quality is improved.

Moreover, according to this embodiment, guide rib 90 can move perpendicularly to guide face 88 of relay guide 86, is projected from guide face 88 only when necessary, and controls the width of sheets of paper P, so that guiding of sheets of paper P in another size is not disturbed and the operations of paper supply roller 84 and separation conveying roller 87 and the detection operation of sheets of paper P by actuator 85*a* are neither disturbed. Furthermore, guide rib 90 moves in link motion with side guides 81*a* and 81*b*, so that there is no need to install an exclusive mechanism for moving guide rib 90.

Further, the present invention is not limited to the aforementioned embodiment and can be modified variously within the scope of the present invention. For example, the image forming apparatus may be a color image forming apparatus and the material, weight, and size of sheets supplied manually from the sheet conveying device are optional.

Further, the moving member for controlling the width of sheets by the relay member may form a guide, without interlocking with the side guide, by performing a movement operation by a moving mechanism for projecting the moving member, for example, by setting the sheet size from the panel by a user. Furthermore, as a moving member, a part of the bottom of the relay member may be structured so as to swing. In the relay member having such a structure, when guiding a sheet in a predetermined direction, a part of the bottom equivalent to the width of the sheet is moved down by one step and the sheet passes through the concavity formed on the relay member. By doing this, at the both-side edges of the concavity, the sheet can be controlled in width and can be prevented from an occurrence of skewing. Hereafter, when the part of the bottom which is moved down by one step is returned to its original height and overall the relay member is returned to the flat height, there is no fear that smooth guiding of other sheets in a large size is disturbed.

As described above in detail, according to the present invention, the swingable moving member for controlling the width of sheets is installed on the relay guide neighboring with the sheet support member, thus sheets in a small size and stiff sheets are guided in a predetermined direction free of skewing. Therefore, various kinds of sheets supplied from the sheet support member can be conveyed satisfactorily without being jammed, and no images are shifted during image forming, and the image quality is improved.

What is claimed is:

1. A sheet conveying device comprising:

a sheet support member having a movable side guide to control a width of sheets;

a paper supply member to make contact with and take out the uppermost sheet on the sheet support member;

a relay member arranged at the down stream side in the sheet conveying direction to guide the sheets taken out by the paper supply member in a predetermined direction; and a moving member provided to the relay member to move swingably and control the width of the sheets.

2. The sheet conveying device according to claim 1, wherein the moving member swings in link motion with the side guide.

3. The sheet conveying device according to claim 1, further comprising:

a separation conveying member to separate and convey the uppermost sheet of the sheets taken out by the paper supply member, wherein the relay member is arranged between the paper supply member and the separation conveying member.

4. The sheet conveying device according to claim 1, wherein the side guide can move in parallel with a support face of the sheet support member.

5. The sheet conveying device according to claim 1, wherein the relay member has a slit-shaped opening in a bottom thereof and the moving member is a guide rib projected from the opening when controlling an optional sheet width.

6. The sheet conveying device according to claim 5, wherein the guide rib is projected from the opening by contact with the side guide.

7. A sheet conveying device comprising:

sheet support means for controlling a width of sheets by a movable side guide and supporting the sheets;

paper supply means for taking out the sheets supported by the sheet support means; and relay means for controlling the width of the sheets by a swingable moving member and guiding the sheets taken out by the paper supply means in a predetermined direction.

8. The sheet conveying device according to claim 7, wherein the moving member swings in link motion with the side guide.

9. The sheet conveying device according to claim 7, further comprising:

separation conveying means for separating and conveying the uppermost sheet of the sheets taken out by the paper supply means, wherein the relay means guides the sheets from the paper supply means toward the separation conveying means.

10. The sheet conveying device according to claim 7, wherein the side guide can move in parallel with a support face of the sheet support means.

11. The sheet conveying device according to claim 7, wherein the relay means has a slit-shaped opening in a bottom thereof and the moving member is a guide rib projected from the opening when controlling an optional sheet width.

12. The sheet conveying device according to claim 11, wherein the guide rib is projected from the opening by contact with the side guide.

13. An image forming apparatus comprising:

a sheet support member provided in an apparatus body having a movable side guide to control a width of sheets;

a paper supply member to make contact with and take out the uppermost sheet on the sheet support member;

a relay member arranged at the down stream side in the sheet conveying direction to guide the sheets taken out by the paper supply member in a predetermined direction;

a moving member provided to the relay member to move swingably and control the width of the sheets; and an image forming unit provided in the apparatus body to form an image on the sheets taken out by the paper supply member.

14. The image forming apparatus according to claim 13, wherein the moving member swings in link motion with the side guide.

15. The image forming apparatus according to claim 13, further comprising:

a separation conveying member to separate and convey the uppermost sheet of the sheets taken out by the paper supply member, wherein the relay member is arranged between the paper supply member and the separation conveying member.

16. The image forming apparatus according to claim 13, wherein the side guide can move in parallel with a support face of the sheet support member.

17. The image forming apparatus according to claim 13, wherein the relay member has a slit-shaped opening in a bottom thereof and the moving member is a guide rib projected from the opening when controlling an optional sheet width.

18. The image forming apparatus according to claim 17, wherein the guide rib is projected from the opening by contact with the side guide.

* * * * *